US008646114B1

(12) United States Patent
Williams

(10) Patent No.: US 8,646,114 B1
(45) Date of Patent: Feb. 11, 2014

(54) SYSTEM AND APPARATUS FOR THE PREVENTION OF THE USE OF CERTAIN INTERVENTIONS ON VULNERABLE PATIENTS

(76) Inventor: Antoinette Williams, Camarillo, CA (US)

( * ) Notice: Subject to any disclaimer, the term of this patent is extended or adjusted under 35 U.S.C. 154(b) by 42 days.

(21) Appl. No.: 13/374,171

(22) Filed: Dec. 13, 2011

Related U.S. Application Data

(60) Provisional application No. 61/460,679, filed on Jan. 5, 2011.

(51) Int. Cl.
*A41D 10/00* (2006.01)

(52) U.S. Cl.
USPC ..... 2/114

(58) Field of Classification Search
USPC ..... 2/114, 456, 457, 46, 69, 93, 51, 82, 84, 2/85, 901, 202; 442/79, 85
See application file for complete search history.

(56) References Cited

U.S. PATENT DOCUMENTS

| | | | | |
|---|---|---|---|---|
| 6,138,278 | A * | 10/2000 | Taylor et al. | 2/114 |
| 6,182,291 | B1 * | 2/2001 | Garvey | 2/102 |
| 6,499,143 | B2 * | 12/2002 | Garza | 2/114 |
| 7,627,908 | B1 * | 12/2009 | Pinckney, II | 2/51 |
| 7,685,649 | B2 * | 3/2010 | Jordan et al. | 2/51 |
| 7,802,313 | B2 * | 9/2010 | Czajka | 2/51 |
| RE42,628 | E * | 8/2011 | Aperfine et al. | 2/82 |

* cited by examiner

*Primary Examiner* — Tejash Patel
(74) *Attorney, Agent, or Firm* — Sandy Lipkin

(57) ABSTRACT

A system and apparatus of coded gowns to alert health care workers of the status of vulnerable patients and where on the patient's body the vulnerable portions are located. The use of color-coded gowns follows the patient on his or her person and is therefore less likely to be lost or unseen information, thereby avoiding physical calamity and legal liability.

5 Claims, 2 Drawing Sheets

SYSTEM AND APPARATUS FOR THE PREVENTION OF THE USE OF CERTAIN INTERVENTIONS ON VULNERABLE PATIENTS

REFERENCE TO PRIOR APPLICATION

This application claims the priority of provisional application 61/460,679, filed Jan. 5, 2011 entitled SYSTEM AND APPARATUS FOR THE PREVENTION OF THE USE OF CERTAIN INTERVENTIONS ON VULNERABLE PATIENTS by Antoinette Williams.

BACKGROUND OF THE INVENTION

1. Field of the Invention

The present invention relates to devices and systems to aid health care workers in determining areas of a patient's body that need particular attention to reduce unnecessary harm.

2. Description of the Prior Art

Hospital care for patients typically includes an intake procedure that, among other things, allows health care workers to determine whether or not a particular patient is what is considered "vulnerable."

An example of a vulnerable patient is one that for one of many medical reasons, such as medical hardware implanted in the body or other complications from surgeries, cannot have certain portions of the body squeezed for blood pressure measurement or punctured through the insertion of needles. Some examples of conditions where puncture and pressure would be contraindicated are mastectomy patients (right, left bilateral), lymphedema, AV fistula, hardware (artificial implants), neurological damage, surgical site side and PICC line, among others.

Currently, hospital methods in place to determine and ascertain which patients are the vulnerable ones primarily include the use of verbal intakes. The patient informs the intake nurse or other health care worker of the condition and then the nurse puts a note on the person's bed. Often, however, this note is lost and once the patient is moved to another care center, the information is lost.

Putting pressure on or puncturing these individuals in these vulnerable places can lead to severe medical problems for the patients, including such extreme consequences as amputation. Besides catastrophic harm to a patient, the precariousness of the system also leaves hospitals and health care workers subject to legal liability for malpractice.

It is the object of the instant invention to provide a system and garment that would allow a visual determination of vulnerable portions on any given patient's body that should not pressured or punctured, therefore having the information visibly apparent and traveling along with the patient's person rather than their bed or chart.

SUMMARY OF THE INVENTION

The preferred embodiment of the instant invention provides a gown for use in hospital and health care settings comprising: a front side; a rear side connected to said first side; an open bottom; an open top; a first sleeve; and a second sleeve wherein a portion of said gown is contrasted in appearance to alert health care workers that said portion of the patient's body that is wearing said gown should not be squeezed, punctured or otherwise manipulated in a way contraindicated by the vulnerability of said patient in said portion of said gown.

The above embodiment can be further modified to defining that the front side is divided in half in order to contrast the appearance of one half of said front side.

The above embodiment can be further modified by defining that the rear side is divided in half in order to contrast the appearance of one half of said rear side.

The above embodiment can be further modified by defining that the first sleeve is contrasted in appearance from the rest of said gown.

The above embodiment can be further modified by defining that the second sleeve is contrasted in appearance from said rest of gown.

A second embodiment defines a method of avoiding the pressure, puncture or other harmful intervention to health care patients with vulnerable body parts through the use of visual cues provided by a specialized hospital gown, comprising the steps of determining from said health care patients whether or not there are any vulnerable portions of said patients' bodies; when vulnerable portions of said patients' bodies are ascertained to be present, providing a specialized gown to identify said vulnerable patient and said vulnerable portion of said patient's body, said gown further comprising: a front side; a rear side connected to said first side; an open bottom; an open top; a first sleeve; and a second sleeve wherein a portion of said gown is contrasted in appearance to alert health care workers that said portion of the patient's body that is wearing said gown should not be squeezed, punctured or otherwise manipulated in a way contraindicated by the vulnerability of said patient in said portion of said gown.

The above embodiment can be further modified by defining that the front side is divided in half in order to contrast the appearance of one half of said front side.

The above embodiment can be further modified by defining that the rear side is divided in half in order to contrast the appearance of one half of said rear side.

The above embodiment can be further modified by defining that the first sleeve is contrasted in appearance from the rest of said gown.

The above embodiment can be further modified by defining that the second sleeve is contrasted in appearance from said rest of gown.

BRIEF DESCRIPTION OF THE DRAWINGS

This invention can better be understood by reference to the drawings, provided for exemplary purposes, and in which.

DETAILED DESCRIPTION OF A PREFERRED EMBODIMENT

The preferred embodiment of the invention is illustrated in the attached figures.

The instant invention provides a gown 10 that indicates to health care workers those portions of the body that should not be pressured or punctured. A gown 10 is provided that is color coded to specify which portions of the body can or cannot be used for puncture or pressure readings.

Figure 2:
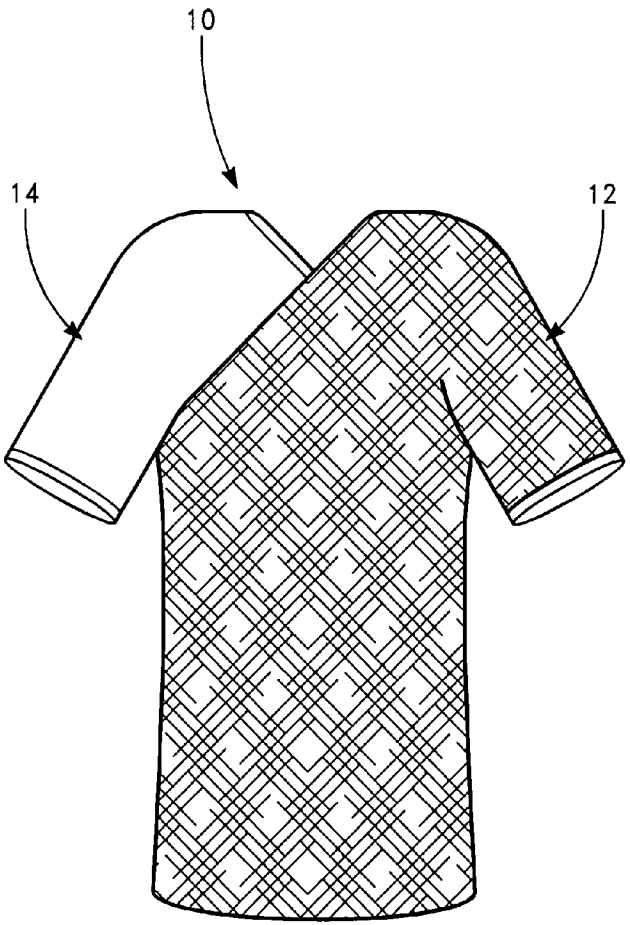
FIG. 2 is a front view of a sample garment of the instant invention wherein the right arm is the vulnerable portion of the body.
Figure 1:
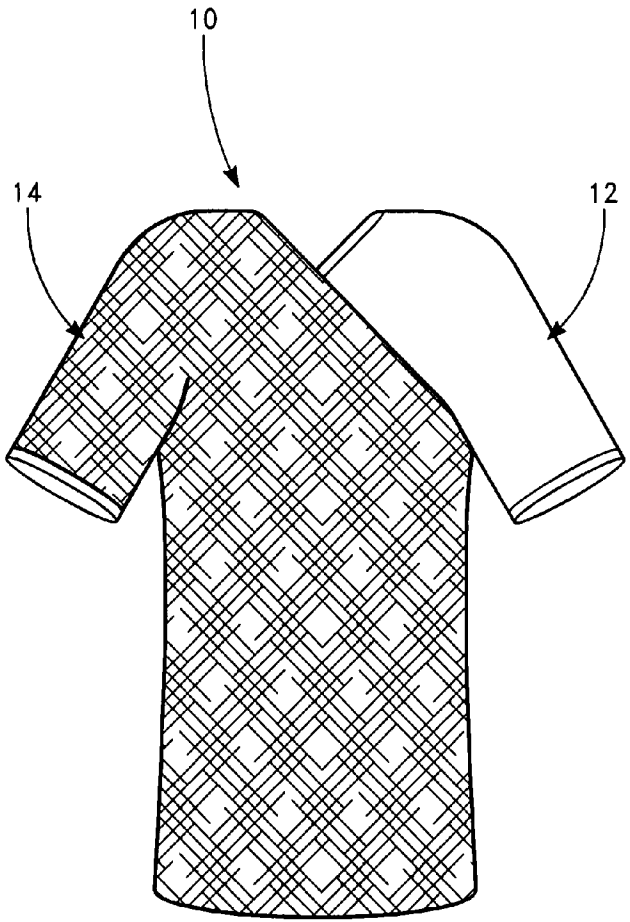
FIG. 1 is a front view of a sample garment of the instant invention wherein the left arm is the vulnerable portion of the body.

In FIG. 1, the patient would have a vulnerable portion of the body on the left arm 12. Note that the garment 10 in its entirety is shaded to indicate a uniform color or shade. The left arm 12 is an opposing color or shading to indicate its exceptionalness with regard to its ability to be squeezed or punctured. Likewise, in FIG. 2, it is the right arm 14 rather than the left arm 12 that is to be treated separately.

Figure 4:
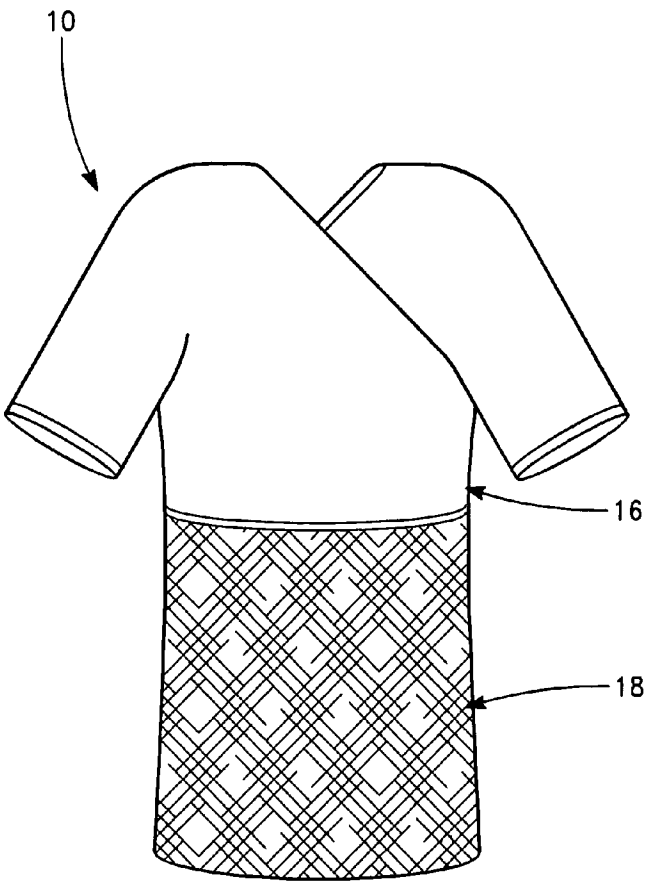
FIG. 4 is a front view of a sample garment of the instant invention wherein the top portion of the torso is the vulnerable portion of the body.
Figure 3:
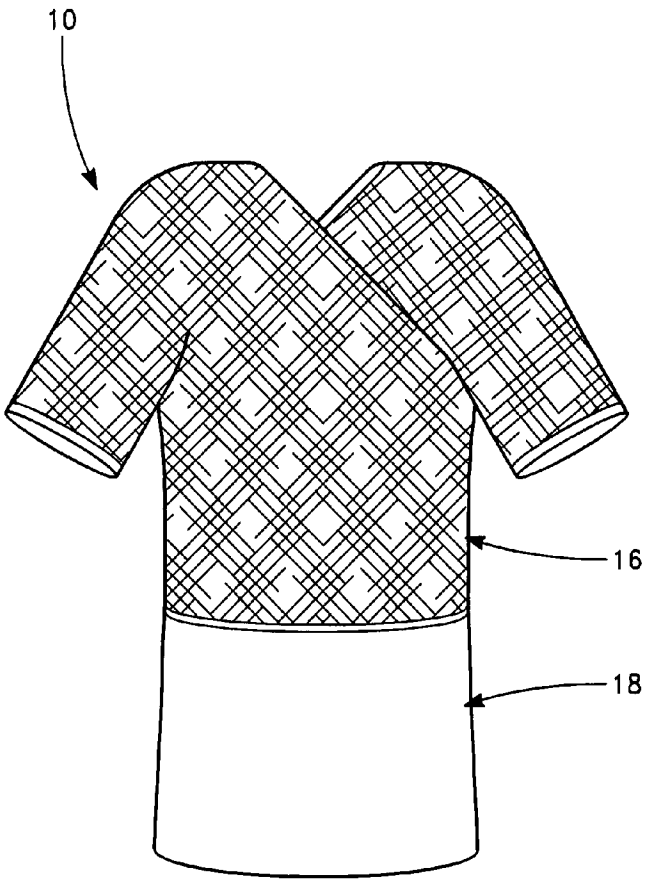
FIG. 3 is a front view of a sample garment of the instant invention wherein the bottom portion of the torso is the vulnerable portion of the body.

In the case of the torso being separated, FIGS. 3-4 indicate that either that the top portion 16 of the torso or the bottom portion 18 of the torso can be excluded from invasive and harmful procedures.

Not shown, but within the scope of this invention are garments that would likewise indicate vulnerable body parts that utilize a garment that covers the legs.

It is important to note that the exact color and shading is not specified. Rather, a system is described wherein the coding would be universally known once implemented so health care workers would be able to know upon sight which areas are free to puncture or pressure and which areas are not.

The illustrations and examples provided herein are for explanatory purposes and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

What is claimed is:

1. A method of avoiding the pressure, puncture or other harmful intervention to health care patients with vulnerable body parts through the use of visual cues provided by a specialized patient hospital gown, comprising the steps of determining from said health care patients whether or not there are any vulnerable portions of said patients' bodies;

when vulnerable portions of said patients' bodies are ascertained to be present, providing the choice of a specialized gown to identify said vulnerable patient and said vulnerable portion of said patient's body, said choice of gowns being chosen among the group comprising:

a first gown with a front side;

a rear side connected to said first side an open bottom;

an open top;

a first sleeve; and a second sleeve wherein said first sleeve of said gown is contrasted in appearance by a contrast in color with the rest of said gown to alert health care workers that said portion of the patient's body covered by said first sleeve should not be squeezed, punctured or otherwise manipulated in a way contraindicated by the vulnerability of said patient in said portion of said gown;

a second gown with a front side;

a rear side connected to said first side;

an open bottom;

an open top;

a first sleeve; and a second sleeve wherein a portion of said front and back side of said gown is contrasted in appearance by a contrast in color to alert health care workers that said portion of patient's body covered by said portion of said front and back side should not be squeezed, punctured or otherwise manipulated in a way contraindicated by the vulnerability of said patient in said portion of said gown;

a third gown with a front side;

a rear side connected to said first side;

an open bottom;

an open top;

a first sleeve; and a second sleeve wherein said second sleeve of said gown is contrasted in appearance by a contrast in color to alert health care workers that said portion of patient's body covered by said second sleeve should not be squeezed, punctured or otherwise manipulated in a way contraindicated by the vulnerability of said patient in said portion of said gown.

2. A method as defined in claim 1 wherein said front side of said second gown is divided in half in order to contrast the appearance of one half of said front side through contrasting colors.

3. A method as defined in claim 1 wherein said rear side of said second gown is divided in half in order to contrast the appearance of one half of said rear side through contrasting colors.

4. A method as defined in claim 1 wherein said first sleeve of said first gown is contrasted in appearance from the rest of said gown through contrasting colors.

5. A method as defined in claim 1 wherein said second sleeve of said third gown is contrasted in appearance from said rest of gown through contrasting colors.

* * * * *